US009527275B1

(12) United States Patent
Flannigan et al.

(10) Patent No.: US 9,527,275 B1
(45) Date of Patent: Dec. 27, 2016

(54) HIGH ACCURACY INKJET PRINTING

(71) Applicant: Southwest Research Institute, San Antonio, TX (US)

(72) Inventors: William C. Flannigan, San Antonio, TX (US); Glynn R. Bartlett, Boerne, TX (US); Cody E. Bressler, San Antonio, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 0 days.

(21) Appl. No.: 15/044,764

(22) Filed: Feb. 16, 2016

(51) Int. Cl.

| | |
|---|---|
| ***B41J 29/393*** | (2006.01) |
| ***B41J 2/045*** | (2006.01) |
| ***B41J 2/21*** | (2006.01) |
| ***B41J 11/42*** | (2006.01) |
| ***B41J 3/407*** | (2006.01) |
| ***B41J 11/00*** | (2006.01) |
| ***B41J 11/46*** | (2006.01) |
| ***B41J 25/304*** | (2006.01) |
| ***B41J 3/54*** | (2006.01) |
| ***B41J 25/308*** | (2006.01) |
| ***B41J 25/20*** | (2006.01) |

(52) U.S. Cl.
CPC ..... *B41J 2/04505* (2013.01); *B41J 2/04556* (2013.01); *B41J 2/04558* (2013.01); *B41J 2/2132* (2013.01); *B41J 2/2135* (2013.01); *B41J 2/2146* (2013.01); *B41J 3/407* (2013.01); *B41J 3/4073* (2013.01); *B41J 3/543* (2013.01); *B41J 11/008* (2013.01); *B41J 11/42* (2013.01); *B41J 11/46* (2013.01); *B41J 25/20* (2013.01); *B41J 25/304* (2013.01); *B41J 25/308* (2013.01)

(58) Field of Classification Search
CPC ..... B41J 2/04558; B41J 2/2135; B41J 2/2132; B41J 2/2146; B41J 11/008; B41J 11/46; B41J 11/42; B41J 3/543; B41J 25/20
See application file for complete search history.

(56) References Cited

U.S. PATENT DOCUMENTS 8,545,943 B2 10/2013 Frankenberger et al.

OTHER PUBLICATIONS

"Think Ink: Airbus Revolutionises How an Airline's Livery is applied to Jetliners" <<http://www.airbus.com/newsevents/news-events-single/detail/think-ink-airbus-revolutionises-how-an-air-lines-livery-is-applied-to-jetliners/>> (accessed Apr. 28, 2016).
"Gray Code"; <<https://en.wikipedia.org/wiki/Gray_code>> (accessed Apr. 28, 2016).

*Primary Examiner* — Julian Huffman
(74) *Attorney, Agent, or Firm* — Grossman, Tucker et al

(57) ABSTRACT

Large area inkjet printing includes the precise deposition of a number of graphic swathes on complex surface to form a continuous graphic image. Each of the graphic swathes should be aligned such that no spaces, gaps, or discontinuities exist within the final graphic image. A large area inkjet printing system provides the requisite accuracy for each graphic swathe forming the final graphic image through the use of an encoder pattern. An encoder pattern is deposited on the surface in a known location with respect to the most recently deposited graphic swathe. The high-accuracy inkjet printing system locates the print head with respect to the encoder pattern thereby permitting the precise positioning of the current graphic swathe.

38 Claims, 6 Drawing Sheets

HIGH ACCURACY INKJET PRINTING

TECHNICAL FIELD

The present disclosure relates to relatively high accuracy printing using one or more pigmented liquids.

BACKGROUND

Painting of surfaces having numerous facets and/or curved surfaces is a time consuming process that requires the application of several coats (layers) of paint. Such surfaces are often found on vehicles which may have complex surface combinations that include facets, curves and compound curves. While the primary function of paint is often corrosion control, paint also provides a distinguishing livery that may be applied as a top coat for utilitarian, branding, aesthetic, and/or marketing purposes. In contrast to monochromatic primer and base coats, liveries may be multicolored and have complex geometries which may include complex digital patterns, logos, graphics or even photorealistic images. Creating these graphics requires significant time and labor expenditures. This is particularly true of the initial masking step that obliges workers to manually fix a stencil on the vehicle to prevent overspray into non-decorated areas. Because of the difficulty in accurately laying down the masking material on large, complex surfaces this process is prone to error and time consuming. In addition, masking operations and the multiple paint/cure cycles limit throughput in paint hangars, which further increases operational costs.

Ink or paint-jet technology has the potential to eliminate masking requirements by directly printing graphics on the vehicular surfaces. This capability is analogous to inkjet printing on paper and uses many of the same technologies. Current inkjet printing techniques have demonstrated great versatility with respect to scale and printing substrate. Commercial billboard makers have used large-scale inkjet printing for years as a means of creating highly detailed marketing signs. More recently, vehicle manufacturers have experimented with this technique. However, current inkjet printing technologies can only reliably and accurately print on flat or nearly flat surfaces. To fully leverage the advantages of inkjet printing on vehicular surfaces, one must be able to print on all (or most) vehicle surfaces, including those with complex physical geometries such as compound curves.

BRIEF DESCRIPTION OF THE DRAWINGS

Features and advantages of various embodiments of the claimed subject matter will become apparent as the following Detailed Description proceeds, and upon reference to the Drawings, wherein like numerals designate like parts, and in which:

Figure 1:
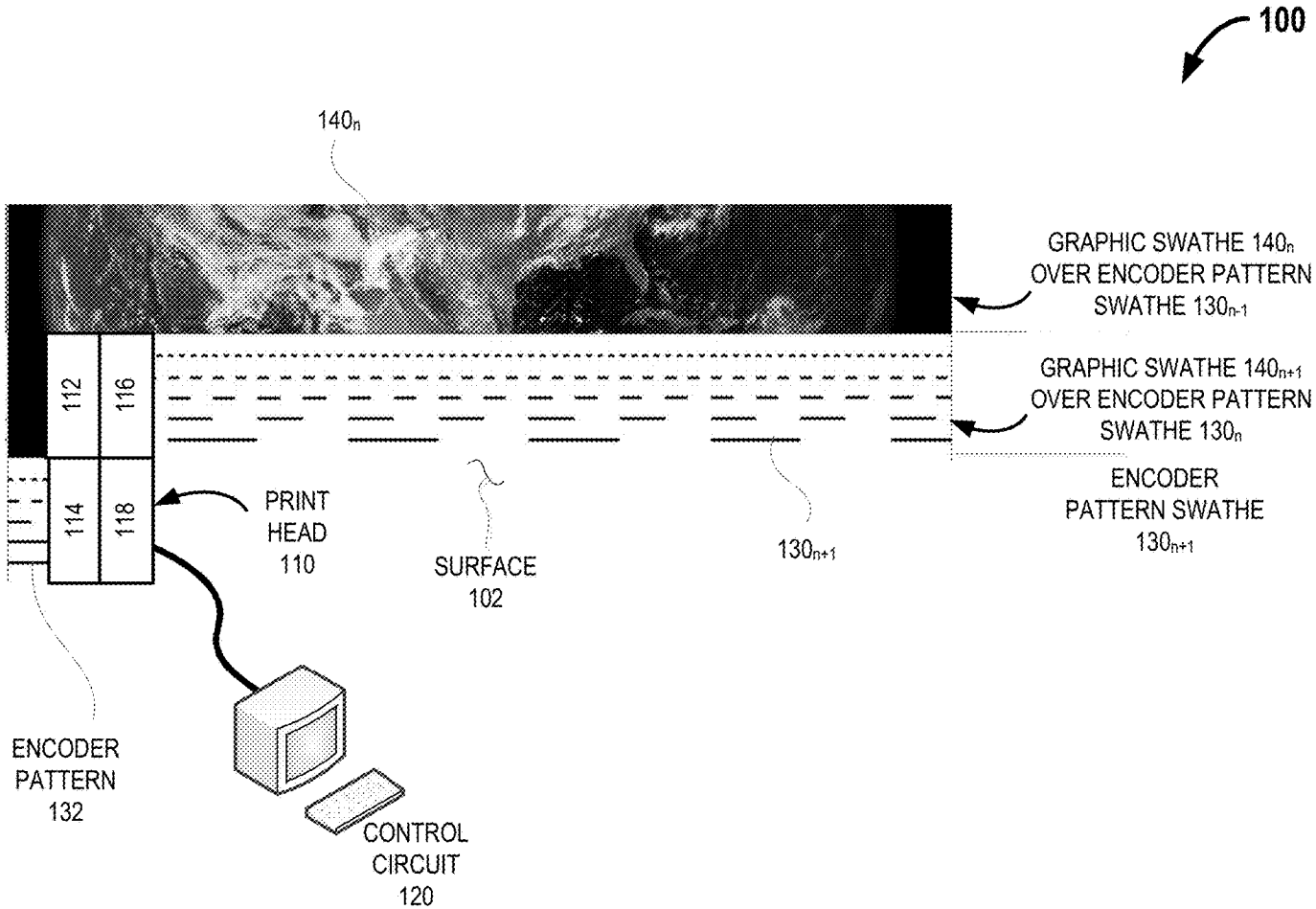
FIG. 1 is a schematic diagram of an illustrative large format inkjet printing system, in accordance with at least one embodiment of the present disclosure.

Although the following Detailed Description will proceed with reference being made to illustrative embodiments, many alternatives, modifications and variations thereof will be apparent to those skilled in the art.

DETAILED DESCRIPTION

A key challenge in developing a large-area inkjet printing system is the positional accuracy required to achieve a seamless graphic that presents the appearance of a continuous graphic image rather than a graphic image composed of a series of parallel graphic swathes. Although small scale output inkjet printers are able to achieve 300 dots per inch (dpi) or greater printing resolution, a resolution of 100 dpi on a large scale output, such as an aircraft fuselage or vertical stabilizer, generally provides a graphic image of sufficient sharpness and clarity. To achieve a printing resolution of 100 dots-per-inch requires the print head to hold and maintain a positional accuracy of 1/100 of an inch (i.e., 0.01 inches or 0.25 millimeters) across the extent of the graphic image. Current robotic technologies having sufficient reach suitable for application of large-scale graphics to commercial airliners are unable to economically attain this level of accuracy; and instead are able to economically achieve an accuracy in the neighborhood of ±1 inch over an area the size of an aircraft. Thus, inkjet head positioning accuracy must improve by about three orders of magnitude (i.e., from ±1 inch to ±0.01 inch) to make inkjet printing techniques practical for use on large-scale surfaces such as those found on many current vehicles such as cars, trucks, buses, civilian aircraft, and military aircraft.

Challenges also exist with printing on the curved and/or irregular surfaces, such as the fuselage or empennage of civilian and military aircraft. For example, as the curvature of a surface such as an aircraft fuselage increases, the geometric properties and color representation of the graphic will experience distortion unless appropriate compensatory steps are taken when applying the graphic. The curvature of a surface may also restrict the useful size of the printing end effector or print head. For example, a large gantry may provide a large, relatively flat, surface area, but is incapable of using the full extent of the area provided to effectively and efficiently apply a graphic image on a curved surface such as an aircraft fuselage.

An encoded pattern and a graphic swathe may be applied contemporaneously to a large-scale surface to improve positional accuracy of an inkjet print head. Such encoded patterns may be applied using a dedicated print head separate from the graphic application print head used to apply the graphic swathe, or may be applied by the graphic application print head, for example along an edge of the graphic swathe or as a specialty pigmented fluid visible in a limited portion of the electromagnetic spectrum (e.g., a pigmented fluid that fluoresces when exposed to ultraviolet light but is otherwise invisible.

In such applications, the encoded pattern may be used to determine the position of the inkjet print head with respect to a previously applied graphic swathe, for example the immediately preceding graphic swathe. This approach leverages the relatively high accuracy achievable by mounting a first liquid ejector to deposit graphics and a second liquid ejector to deposit the encoder pattern in a defined physical configuration within the same print head. For each graphic swathe deposited by the print head, a corresponding encoder pattern may be deposited at a known location measured with respect to the graphic swathe. When the control circuit locates the print head with respect to the encoder pattern, the control circuit is able to determine the location of the first liquid ejector with respect to a previously deposited graphic image. Thus, successive graphic swathes may be aligned to the accuracy limits of the inkjet printing process itself. The accuracy of such a printing system thus relies upon the uniform, defined, relationship between the first liquid ejector and a second liquid ejector to build a precise relationship between a graphic swathe and a respective encoder pattern rather than requiring high absolute accuracy of the robot used to apply the graphic swathe in the absence of the encoder pattern.

Since the physical relationship between the encoder pattern and the previously deposited graphic swathe is defined, by precisely locating the print head with respect to the encoder pattern, the control circuit is able to determine the precise position the print head with respect to the previously deposited graphic swathe. By determining the precise position of the print head with respect to the previously deposited graphic swathe, the control circuit is able to deposit any number of individual graphic swathes on the surface to form a seamless large scale graphic image.

Such encoded pattern may include any known pseudo-random pattern, or may include a known pattern such as a gray-coded binary pattern commonly found on absolute encoders. The encoded pattern may be printed simultaneously with the graphic swathe and may have a defined physical relationship to the respective graphic swathe. For example, in some embodiments, the encoder pattern may be physically displaced or offset from the respective graphic swathe by a mathematically definable relationship. In other embodiments, the encoder pattern may be applied as a portion of the graphic swathe (e.g., along an edge of the graphic swathe) or over at least a portion of the graphic swathe (e.g., as an optically clear pigmented fluid visible under ultraviolet light). With a robotic accuracy of ±1 inch (±25 millimeters) and an ink jet print head positioning requirement of ±0.01 inch (±0.25 millimeters), approximately 8 bits of encoder resolution are required. In practice, one or more state estimation techniques using a motion model of the robotic assembly supporting the inkjet print head may reduce the encoder bit requirement.

A liquid application system is provided. The system may include a print head and a print head controller. The print head may include a first liquid ejector to eject a graphic medium on a surface, a second liquid ejector to eject a pattern medium on the surface; and at least one image acquisition device. The print head controller may be communicably coupled to the first liquid ejector, the second liquid ejector, and the at least one image acquisition device. The print head controller may align the first liquid ejector with an encoder pattern swathe applied to a first portion of the surface, the alignment based at least in part on image data received from the at least one image acquisition device, cause the first liquid ejector to selectively apply a graphic swathe on the first portion of the surface, and cause the second liquid ejector to selectively apply the encoder pattern on a second portion of the surface, the second portion of the surface adjacent to the first portion of the surface.

A pigmented liquid application method is provided. The method may include receiving, by a print head control circuit, data representative of an encoder pattern deposited as an encoder pattern swathe on a first portion of a surface. The method may further include aligning a first liquid ejector with the first encoder pattern based at least in part on the data representative of the encoder pattern. The method may include causing, by the print head control circuit, the first liquid ejector to selectively deposit a graphic swathe over at least a portion of the encoder pattern swathe deposited on the first portion of the surface. The method may additionally include causing, by the print head control circuit, the second liquid ejector to selectively deposit the encoder pattern on a second portion of the surface and causing, by the print head control circuit, the print head to index at the completion of each graphic swathe such that the first liquid ejector applies each subsequent graphic swathe over the encoder pattern previously deposited on the second portion of the surface.

A print head controller apparatus is provided. The controller may include at least one input communicably coupleable to at least one optical scanner in a print head. The controller may additionally include at least one output that communicates with and is coupled to at least a first liquid ejector in the print head and a second liquid ejector in the print head. The controller may additionally include at least one controller circuit communicably coupled to the at least one input interface and the at least one output interface, the controller circuit to: receive, at the at least one input, at least one encoder pattern signal provided by the at least one optical scanner, the at least one encoder pattern signal including data indicative of an encoder pattern applied to a first portion of a surface; responsive to the receipt of the at least one encoder pattern signal, align the print head with the at least one encoder pattern; and responsive to alignment of the print head with the at least one encoder pattern: cause the first liquid ejector to selectively deposit a graphic swathe over the encoder pattern on the first portion of the surface; and cause the second liquid ejector to selectively deposit an encoder pattern on a second portion of the surface, the second portion of the surface adjacent to the first portion of the surface.

As used herein, the term "swathe" and the plural "swathes" refer to a contiguous strip of liquid or pigmented liquid deposited on a surface by a print head. Thus, a graphic swathe refers to a contiguous portion of a graphic image extending from an initial deposition location to a terminal deposition location.

As used herein, an encoder pattern refers to a contiguous portion of an encoder pattern extending from an initial deposition location to a terminal deposition location. The encoder pattern may be disposed distal from the graphic swathe, as a portion of the graphic swathe, or as an overlay on top of all or a portion of the graphic swathe.

FIG. 1 is a schematic diagram of an illustrative large-area inkjet printing system 100, in accordance with at least one embodiment of the present disclosure. The high-accuracy inkjet printing system 100 includes a print head 110. The print head 110 may include a first liquid ejector 112, a second liquid ejector 114, and an image acquisition device 116. In some implementations, the print head 110 may include a housing (not shown in FIG. 1A) disposed at least partially about some or all of the first liquid ejector 112, the second liquid ejector 114, and/or the image acquisition device 116. As depicted in FIG. 1, the print head 110 is oriented such that a direction of travel exists along an x-axis, however the print head 110 is not limited in traveling along only the x-axis and may, in other embodiments, along a y-axis or any combination of x- and y-axes. At least one control circuit 120 is communicably coupled to the print head 110 and at least partially controls the deposition of the liquids/pigmented liquids forming the encoder pattern swathe 130 and the graphic swathe 140 on the surface.

A graphic image deposited on a large-scale surface 102 is composed of a number of graphic swathes $\mathbf{140}_1$-$\mathbf{140}_x$ (collectively "graphic swathes 140") deposited on the surface such that a seamless graphic image results. To achieve such a seamless graphic image, a series of graphic swathes $\mathbf{140}_1$-$\mathbf{140}_x$ and corresponding encoder pattern swathes $\mathbf{130}_1$-$\mathbf{130}_x$ (collectively, "encoder pattern swathes 130") are deposited on the surface 102. For each graphic swathe $\mathbf{140}_n$ deposited on the surface 102, a corresponding encoder pattern swathe $\mathbf{130}_n$ is also deposited on the surface 102 at a defined location with respect to the graphic swathe $\mathbf{140}_n$. The subsequent graphic swathe $\mathbf{140}_{n+1}$ may then be accurately positioned with respect to the encoder pattern swathe $\mathbf{130}_n$ corresponding to graphic swathe $\mathbf{140}_n$ (e.g., positioned above encoder pattern swathe $\mathbf{130}_n$ as depicted in FIG. 1) such that an aligned, seamless, connection occurs between graphic swathe $\mathbf{140}_n$ and graphic swathe $\mathbf{140}_{n+1}$.

The image acquisition device 116 detects an encoder pattern swathe $\mathbf{130}_n$ previously deposited on a surface and aligns the first liquid ejector 112 with the encoder pattern swathe $\mathbf{130}_n$ such that a seamless juncture, connection, or transition is formed between the neighboring, previously applied, graphic swathe $\mathbf{140}_n$ and the currently graphic swathe $\mathbf{140}_{n+1}$. In embodiments, such as that depicted in FIG. 1, after aligning the first liquid ejector 112 with the encoder pattern swathe $\mathbf{130}_n$, the first liquid ejector 112 deposits graphic swathe $\mathbf{140}_{n+1}$ along and over encoder pattern swathe $\mathbf{130}_n$ while maintaining alignment between the first liquid ejector 112 and the encoder pattern swathe $\mathbf{130}_n$. In some implementations, contemporaneous with the deposition of graphic swathe $\mathbf{140}_{n+1}$, and as the print head 110 travels along the surface 102, the second liquid ejector 114 may deposit encoder pattern swathe $\mathbf{130}_{n+1}$ on the surface. After completing graphic swathe $\mathbf{140}_{n+1}$, the high-accuracy inkjet printing system 100 indexes the print head 110 and aligns the first liquid ejector 112 with the encoder pattern swathe $\mathbf{130}_{n+1}$ and applies the subsequent graphic swathe $\mathbf{140}_{n+2}$ over the encoder pattern swathe $\mathbf{130}_{n+1}$. For each graphic swathe $\mathbf{140}_x$, the high-accuracy inkjet printing system 100 may contemporaneously or subsequently generate and deposit on the surface 102 the corresponding encoder pattern swathe $\mathbf{130}_x$ that will be used to align the subsequent graphic swath $\mathbf{140}_{x+1}$ with the previously applied graphic swathe $\mathbf{140}_x$. In embodiments, at the conclusion of graphic swathe $\mathbf{130}_x$, the high-accuracy inkjet printing system 100 may index the print head 110 such that the next graphic swathe $\mathbf{140}_{x+1}$ is deposited over the most recently generated encoder pattern swathe $\mathbf{130}_x$. Such a system leverages the inherent positional accuracy of the encoder pattern swathe $\mathbf{130}_x$ with respect to graphic swathe $\mathbf{140}_m$ to align the deposition of a subsequent graphic swathe $\mathbf{140}_{x+1}$.

The first liquid ejector 112 may include any number or combination of systems and/or devices capable of receiving a pigmented fluid or a pigmented liquid from a reservoir and selectively ejecting the received pigmented liquid onto a surface 102. In various implementations, the first liquid ejector 112 may include any number or combination of orifices, nozzles, ported chambers, or similar apertures through which the pigmented liquid may be selectively ejected under pressure. In some implementations, the first liquid ejector 112 may receive and mix, react, or otherwise combine a number of different color pigmented liquids (e.g., cyan, magenta, yellow, and black pigmented liquids) at each of the orifices, nozzles, ported chambers, or apertures. In such an implementation, a pigmented liquid in a large number of colors and/or hues (e.g., 16 million) may be generated at each of the orifices, nozzles, ported chambers, or apertures.

In some implementations, the first liquid ejector 112 may receive a single color pigmented liquid (e.g., a cyan, a magenta, a yellow, or a black pigmented liquid) at each of the orifices, nozzles, ported chambers, or apertures. In such implementations, the first liquid ejector 112 may selectively eject two or more different color pigmented liquids from different orifices, nozzles, ported chambers, or apertures such that the ejected pigmented liquids mix, react, or otherwise combine to form any one of a large number of colors and/or hues prior to or upon deposition on the surface 102.

In some implementations, the first liquid ejector 112 may receive the pigmented liquid in a solid form. In such implementations, the first liquid ejector 112 may include one or more components, such as one or more heaters, that liquefy the solid pigmented liquid.

The first liquid ejector 112 may produce a graphic swathe 140 having any width. In embodiments, the width of the first liquid ejector 112 may be selected based at least in part on any distortions, contours and/or irregularities apparent in the surface 102 on which the graphic swathe 140 will be deposited. For example, a graphic swathe 140 deposited on a distorted, highly contoured, and/or a highly irregular surface may benefit from a narrower graphic swathe 140. Conversely, a graphic swathe 140 deposited on a lightly contoured and/or a smooth surface may benefit from a wider graphic swathe 140. In some implementations, the first liquid ejector 112 may be capable of selectively producing a variable width graphic swathe 140. In some implementations, the at least one control circuit 120 may alter, adjust, or select a width of the graphic swathe 140 based on one or more measured or detected parameters indicative of a distortion, contour, and/or irregularity associated with the surface 102 on which the respective graphic swathe 140 will be deposited. For example, the at least one control circuit 120 may cause the selective deposition of a narrow graphic swathe 140 on a highly contoured or highly irregular surface. In another example, the at least one control circuit 120 may cause the selective deposition of a wide graphic swathe 140 on a lightly contoured or smooth surface.

The second liquid ejector 114 may include any number or combination of systems and/or devices capable of receiving a liquid from a reservoir and selectively ejecting the received liquid onto a surface disposed in the vicinity of the second liquid ejector 114. In various implementations, the second liquid ejector 114 may include any number or combination of orifices, nozzles, ported chambers, or similar apertures through which the liquid may be selectively ejected under pressure. In some implementations, the second liquid ejector 114 may receive a single pigmented liquid at each of the orifices, nozzles, or apertures (e.g., a liquid containing a single pigment). In such an implementation, the second liquid ejector 114 may selectively deposit a monochromatic encoder pattern swathe 130 on a second portion of the surface that is proximate the graphic swathe 140. In some implementations, the color of the monochromatic encoder pattern swathe 130 may be selected or otherwise determined by the control circuit 120 based at least in part on the composition of the graphic swathe 140 that will overlay all or a portion of the respective monochromatic encoder pattern swathe 130. For example, the control circuit 120 may cause the second liquid ejector 114 to selectively deposit a light gray encoder pattern 132 where the graphic swathe 140 that will overlay the encoder pattern 132 is predominantly light. In another example, the control circuit 120 may cause the second liquid ejector 114 to selectively deposit a dark gray or black encoder pattern 132 where the graphic swathe 140 that will overlay the encoder pattern 132 is predominantly dark.

In some implementations, the second liquid ejector 114 may receive a liquid that fluoresces, glows, or becomes visible when illuminated by electromagnetic radiation in a particular or defined frequency band. Such liquids may include, for example, one or more liquids that glow fluoresce, or become visible when illuminated using near-ultraviolet electromagnetic radiation (e.g., electromagnetic radiation having a wavelength of about 300 nanometers to about 400 nanometers) or near-infrared electromagnetic radiation (e.g., electromagnetic radiation having a wavelength of about 750 nanometers to about 1400 nanometers). In such an implementation, the print head 110 may include one or more emitters or similar electromagnetic radiation sources capable of emitting the appropriate spectra such that the at least one image acquisition device 116 is able to detect the encoder pattern 132.

In some implementations, the second liquid ejector 114 may receive the liquid in a solid form. In such implementations, the second liquid ejector 114 may include one or more components, such as one or more heaters or similar thermal input devices, to liquefy the solid.

The second liquid ejector 114 may produce an encoder pattern swathe 130 of any width. In embodiments, the width of the second liquid ejector 114 may be selected based at least in part on the contour of and/or irregularities in the surface on which the encoder pattern swathe 130 will be deposited. For example, an encoder pattern swathe 130 deposited on a highly contoured and/or a highly irregular surface may benefit from a narrower second liquid ejector 114. Conversely, an encoder pattern swathe 130 deposited on a lightly contoured and/or a smooth surface may benefit from a wider second liquid ejector 114.

In some implementations, the second liquid ejector 114 may be capable of selectively producing a variable width encoder pattern swathe 130. In some implementations, the at least one control circuit 120 may alter, adjust, or select a width of the encoder pattern swathe 130 based on one or more measured or detected parameters associated with the surface on which the respective encoder pattern swathe 130 will be deposited. For example, the at least one control circuit 120 may cause the selective deposition of a narrow encoder pattern swathe 130 on a highly contoured or highly irregular surface. In another example, the at least one control circuit 120 may cause the selective deposition of a wide encoder pattern swathe 130 on a lightly contoured or smooth surface.

The encoder pattern 132 deposited on the surface by the second liquid ejector 114 directly encodes the linear travel of the print head 110 along a single axis (e.g., the x-axis as depicted in FIG. 1). Although depicted in FIG. 1 as a series of dashed lines, the encoder pattern 132 may include any number, combination, and/or type of one-, two-, or three-dimensional pattern(s) detectable by the image acquisition device 116.

In embodiments, the encoder pattern 132 may include unique (i.e., non-repeating) pattern that extends across the entire encoder pattern swathe 130. In other embodiments, the encoder pattern 132 may include a number of identical, repeating encoder pattern segments that have a length greater than or equal to the measurement uncertainty of the device used to position and move the print head 110 (e.g., a robotic arm or other robotic assembly to which the print head 110 is affixed). For example, a print head 110 affixed to a robotic assembly having a positional uncertainty of ±1 inch (±25 mm) and positioned at a location "x" along an axis may be located at any point from "x−1 inch" to "x+1 inch" along the axis. The measurement uncertainty or "range of uncertainty" of the print head is therefore up to 2 inches. In such an instance, an encoder pattern 132 that comprises a repeated unique encoder pattern should have a unique encoder pattern length of at least 2 inches (50 mm), i.e., the measurement uncertainty of the print head based on the positional uncertainty of the robotic assembly. By combining the approximate position of the print head 110 on the surface 102 with the position measured by the encoder pattern 132, the position of the print head along a single axis may be determined to the resolution of the printed pixel size of the encoder pattern 132 deposited on the surface 102.

The image acquisition device 116 may include any number and/or combination of monochromatic or color systems and/or devices capable of detecting the encoder pattern included in the encoder patter swathe 130 deposited on the surface. In embodiments, the image acquisition device may include any number or combination of current or future image acquisition sensors, such as any number of charge coupled device (CCD) image sensors, or any number of complementary metal oxide semiconductor (CMOS) image sensors. In embodiments, the image acquisition device 116 may include one or more image enhancement components, devices, or systems, such as one or more digital signal processors. In some implementations, the image acquisition device 116 may include a plurality of devices, each having different optical properties. For example, the image acquisition device 116 may include a first image capture device having a relatively short focal length and a relatively wide field-of-view useful for obtaining wide angle images of the surface 102, such as images useful for initially positioning the print head on the surface 102. The image acquisition device 116 may further include a second image capture device having a relatively long focal length and a relatively narrow field-of-view useful for obtaining narrow angle or detail images of the surface 102, such as detail images of the encoder pattern 132 on the surface 102.

In some implementations, the image acquisition device 116 may include one or more optical image acquisition devices, such as one or more still or video cameras capable of capturing images in at least a visible portion of the electromagnetic spectrum (i.e., at wavelengths of from about 390 nanometers (nm) to about 700 nm). In such implementations, all or a portion of the encoder pattern 132 may be deposited on the surface 102 using a liquid carrying one or more pigments capable of producing the encoder pattern 132 when illuminated using electromagnetic energy in the visible portion of the electromagnetic spectrum. In some implementations, the print head 110 may include at least one emitter 118 capable of producing and/or emitting electromagnetic radiation at one or more defined wavelength ranges such that the encoder pattern 130 is visible to at least the image acquisition device 116 when illuminated using electromagnetic energy produced by the at least one emitter 118. In embodiments, the at least one emitter 118 may include, but is not limited to, a number of solid-state light electromagnetic sources (e.g., a light emitting diode—LED) or any other current or future developed electromagnetic emitter capable of generating and emitting electromagnetic radiation at wavelengths across all or a portion of the visible electromagnetic spectrum.

In some implementations, the image acquisition device 116 may include any number of individual image acquisition devices, such as any number of image sensors capable of capturing images outside of the visible portion of the electromagnetic spectrum (i.e., at wavelengths of less than about 390 nanometers (nm) or at wavelengths greater than about 700 nm). In such implementations, the print head 110 may include at least one emitter 118 capable of producing and/or emitting electromagnetic radiation at one or more defined wavelength ranges such that the encoder pattern 130 is visible to at least the image acquisition device 116 when illuminated using electromagnetic energy provided by the at least one emitter 118. In embodiments, the at least one emitter 118 may include, but is not limited to, a number of solid-state light electromagnetic sources (e.g., a light emitting diode—LED) or any other current or future developed electromagnetic emitter capable of generating and emitting electromagnetic radiation at wavelengths outside of the visible electromagnetic spectrum.

The image acquisition device 116 generates at least one signal that may include information or data representative of at least the encoder pattern 132 proximate the print head 110. In some implementations, the image acquisition device 116 may wirelessly communicate all or a portion of the at least one signal to a control circuit 120 located remote from the print head 110. In other implementations, the image acquisition device 116 may communicate all or a portion of the at least one signal to a control circuit 120 located remote from the print head 110 via one or more wired or tethered connections, such as a universal serial bus (USB) cable, or via a hard bus that is internal to a processor-based device that is providing at least a portion of the control circuit 120. In some implementations, the image acquisition device 116 may communicate all or a portion of the at least one signal to a control circuit 120 disposed at least partially within the print head 110.

In some implementations, the at least one emitter 118 may include a structured light emitting system. In such implementations, the at least one emitter 118 may emit or otherwise produce a structured light pattern across at least a portion of the second portion of the surface 102. Such structured light patterns may provide information relevant to the presence of contours and/or irregularities that may be present in or on the surface 102. The image acquisition device 116 may communicate one or more signals that include information or data representative of the structured light pattern formed on the surface 102 to the control circuit 120. The control circuit 120 may use the information or data representative of the structured light pattern formed on the surface 102 to identify and measure at least one physical, mechanical, and/or optical parameter associated with each of the contours or irregularities (extent, depth, radius of curvature, glossiness, reflectance, etc.).

The control circuit 120 alters, adjusts, or controls the position and/or movement of the print head 110 relative to the surface 102. The control circuit 120 may include any number and/or combination of devices and/or systems capable of detecting the encoder pattern 132, aligning the first liquid ejector 112 with the encoder pattern 132, causing the first liquid ejector 112 to deposit a graphic swathe $\mathbf{140}_n$ over the encoder pattern 132, and causing the second liquid ejector 114 to deposit an encoder pattern swathe $\mathbf{130}_n$ at a defined position with respect to the graphic swathe $\mathbf{140}_n$. In some implementations, the control circuit 120 may cause the second liquid ejector 114 to deposit an encoder pattern swathe $\mathbf{130}_n$ at a defined position with respect to the graphic swathe $\mathbf{140}_n$ contemporaneous with the deposition of the graphic swathe $\mathbf{140}_n$. In some implementations, the control circuit 120 may cause the second liquid ejector 114 to deposit an encoder pattern swathe $\mathbf{130}_n$ at a defined position with respect to the graphic swathe $\mathbf{140}_n$ subsequent to the deposition of the graphic swathe $\mathbf{140}_n$. In embodiments, all or a portion of the control circuit 120 may be disposed in the print head 110. In other embodiments, all or a portion of the control circuit 120 may be disposed external to or remote from the print head 110.

In embodiments, the control circuit 120 may include, but is not limited to, any one or more of the following: a hard-wired control circuit, a generic processor capable of executing machine readable instructions that cause the processor to function as a specialized high-accuracy inkjet control circuit, an application specific integrated circuit (ASIC), a field programmable gate array (FPGA), a programmable controller, a digital signal processor (DSP), a reduced instruction set computer (RISC), or a system on a chip (SoC). In some implementations, the control circuit 120 may be implemented in whole or in part as a portion of a system controller or processor, for example as a thread in a single- or multi-core microprocessor.

In some implementations, the control circuit 120 may perform a structured light analysis of at least a portion of the second portion of the surface 102 on a one-time, periodic, aperiodic, or continuous basis. For example, the control circuit 120 may perform the structured light analysis on a continuous basis to detect the presence of contours or irregularities present on the surface as the print head 110 traverses the surface and prior to depositing the graphic swathe 140 and/or the encoder pattern swathe 130 on the surface. In various implementations, the control circuit 120 may alter or adjust at least one operational parameter such that the graphic image and/or encoder pattern deposited on the surface minimizes or masks the contours and/or surface irregularities when viewed from one or more viewing angles or one or more viewing angle ranges. In other implementations, the control circuit 120 may alter or adjust at least one operational parameter of the first liquid ejector 112 and/or the second liquid ejector 114 in response to detecting contours or irregularities in the surface that would adversely impact (e.g., distort the appearance of) the contents of the graphic swathe 140. Such operational parameter adjustments may include, but are not limited to, adjusting the velocity of the pigmented liquid deposited on the surface, adjusting the composition of the pigmented liquid deposited on the surface, adjusting the distance between the liquid ejector and the surface, traverse speed of the print head across the surface, or combinations thereof.

Figure 2A:
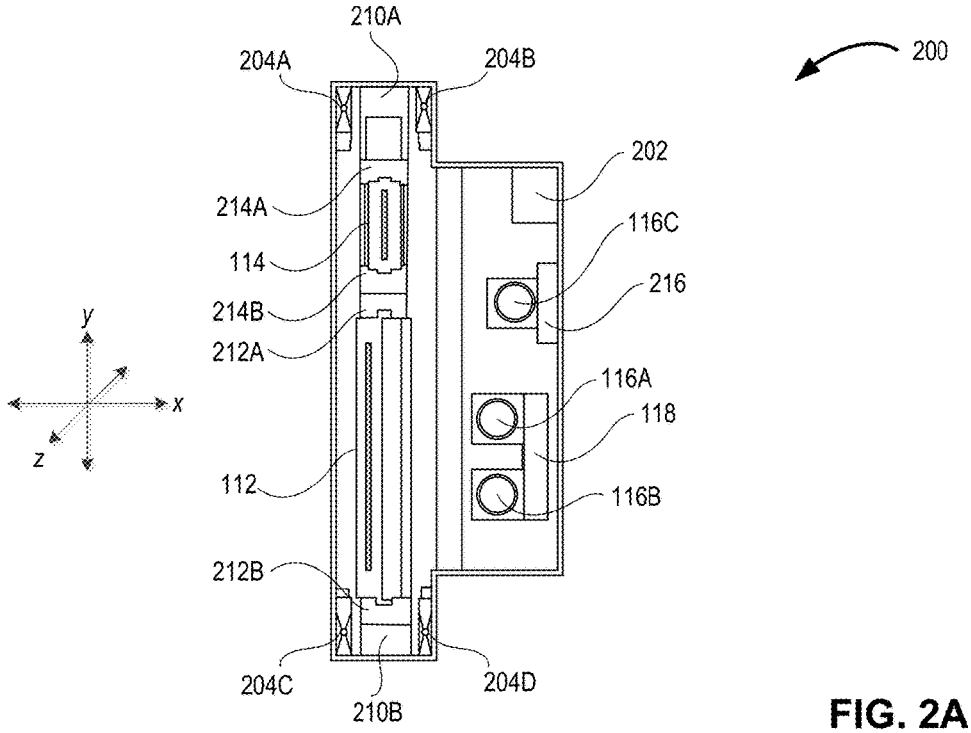
FIG. 2A is an elevation of an illustrative large format inkjet printing system print head, in accordance with at least one embodiment of the present disclosure.
Figure 2B:
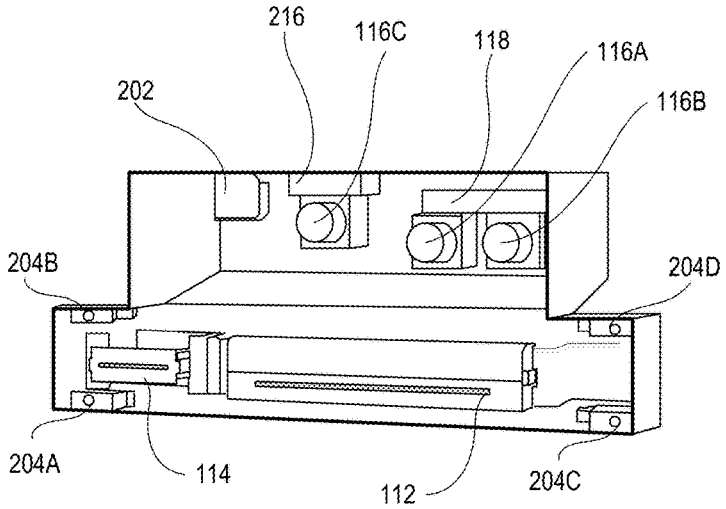
FIG. 2B is a perspective view of the illustrative large format inkjet printing system print head depicted in FIG. 2A, in accordance with at least one embodiment of the present disclosure.

FIG. 2A provides an elevation of an illustrative high-accuracy inkjet printing system print head 200, in accordance with at least one embodiment of the present disclosure. FIG. 2B provides a perspective view of the illustrative high-accuracy inkjet printing system print head 110 depicted in FIG. 2A, in accordance with at least one embodiment of the present disclosure. The print head 200 depicted in FIGS. 2A and 2B includes a number of components that assist in positioning the print head over the surface 102. In addition to the first liquid ejector 112, the second liquid ejector 114, and the illumination source 118, the print head 200 preferably includes at least three image acquisition devices, 116A, 116B, and 116C. Image acquisition device 116A may scan the encoder pattern 132, image acquisition device 116B may assist with encoder pattern image processing, and laser image acquisition device 116C may visually detect a laser line projected on the surface 102.

The print head 200 preferably includes at least one inertial measurement unit (IMU) 202. In embodiments, the inertial measurement unit (IMU) may produce or otherwise generate a number of signals that include data representative of a velocity of the print head 200 along one or more axes, data representative of an orientation of the print head 200, and/or data representative of an acceleration of the print head 200 along one or more axes, using a combination of accelerometers, gyroscopes, and/or magnetometers. In some implementations, the IMU 202 may include an IMU capable of measuring acceleration along a plurality of degrees-of-freedom, for example a nine (9) degree-of-freedom IMU. In some instances, the inertial data provided by the IMU 202 may be used to monitor the tilt of the print head 200. In some instances, at least a portion of the inertial data provided by the IMU 202 may be provided to the control circuit 120. In at least some implementations, the data provided by the IMU 202 may be used by the control circuit 120 to perform one or more path prediction methods to determine the path the print head 200 follows along the surface 102.

The print head 200 may include a plurality of standoff or distance sensors 204A-204D (collectively, "standoff sensors 204") that each generate at least one signal that includes information or data representative of the distance between the print head 200 and the surface 102. Each of the plurality of standoff sensors 204 may include a noncontact distance sensor, for example an ultrasonic distance sensor. Each of the plurality of standoff sensors 204 may be positioned in a corner of the print head 200 such that the distance between any portion of the print head 200 and the surface 102 (e.g., the distance along the z-axis) may be accurately measured. In some implementations, some or all of the plurality of standoff sensors 204 may provide to the control circuit 120 one or more signals that include information or data representative of an orientation about a pair of orthogonal axes that define a plane containing at least a portion of the surface 102 (e.g., the orientation along the x-axis and the y-axis).

The print head 200 may include a plurality of actuateable elements 210A-210B (collectively, "actuateable elements 210"). The actuateable elements 210 may include any number or combination of linear actuateable elements for positioning the print head 200 along one or more principal orthogonal axes (e.g., x-axis, y-axis, z-axis) and/or any number or combination of rotary actuateable elements for positioning the print head about one or more principal orthogonal axes (e.g., roll, pitch, yaw). Each of the plurality of actuateable elements 210 may receive a signal from the control circuit 120. In embodiments, the control circuit 120 may cause the actuateable elements 210 to alter, control, or otherwise adjust the position of the print head 200 along an axis normal to the graphic swathe 140 (i.e., along the y-axis as depicted in FIG. 2A). In at least some embodiments, the control circuit 120 may alter, control, or otherwise adjust the position of the print head 200 along an axis normal to the graphic swathe 140 in response to receipt of one or more signals from the image acquisition device(s) 116A and 116B. The actuateable elements 210 enable the print head 200 to compensate for any minor misalignment along the axis normal to the graphic swathe 140 attributable to the positional error of a support structure or robotic device to which the print head 200 is attached. In at least some implementations, the actuateable elements may include a number of high-bandwidth linear actuators. Each of the number of high-bandwidth linear actuators are capable of rapid movement through a small displacement thereby permitting the control circuit 120 to quickly adjust the position of the print head 200 to track the encoder pattern 132 deposited in the encoder pattern swath 130.

In some implementations, the IMU 202 may adjust the movement of the print head 200 to compensate for high-frequency vibrations present in the print head 200. Such high-frequency vibrations may be caused by a variety of sources including the movement of the robot or similar moveable or displaceable structure carrying the print head 200. In operation, the image acquisition devices 116 may provide sufficient resolution and response to permit the actuateable elements 210 to accommodate gross (e.g., greater than 10 millimeters) and low-frequency (e.g., less than 1 Hertz) disturbances. The IMU 202, when combined with a number of high speed actuateable elements coupled to the print head 200 or end effector carrying the print head 200 may compensate for low displacement, high-frequency disturbances. Combined, the actuateable elements 210 and the high-speed actuateable elements are able to stabilize the print head 200 against vibration and compensate for gross inaccuracies of the positioning of the print head 200 during the printing process.

The print head 200 may include a plurality of vertical linear actuators 212A-212B that are operably coupled to the first liquid ejector 112. In embodiments, the control circuit 120 may generate one or more output signals that cause the vertical linear actuators 212A-212B to alter, control, or otherwise adjust the distance or standoff between the first liquid ejector 112 and the surface 102 (i.e., adjust the distance along the z-axis as depicted in FIG. 2A). In at least some embodiments, the control circuit 120 may alter, control, or otherwise adjust the distance or standoff between the first liquid ejector 112 and the surface 102 in response to receipt of one or more signals from the standoff sensors 204 containing information or data representative of the distance or standoff between the first liquid ejector 112 and the surface 102. In some implementations, the control circuit 120 may alter, control, or otherwise adjust the distance or standoff between the first liquid ejector 112 and the surface 102 to compensate for one or more detected contours and/or irregularities in the surface 102.

The print head 200 may include a plurality of vertical linear actuators 214A-214B that are operably coupled to the second liquid ejector 114. In embodiments, the control circuit 120 may generate one or more output signals that cause the vertical linear actuators 214A-214B to alter, control, or otherwise adjust the distance or standoff between the second liquid ejector 114 and the surface 102 (i.e., adjust the distance along the z-axis as depicted in FIG. 2A). In at least some embodiments, the control circuit 120 may alter, control, or otherwise adjust the distance or standoff between the second liquid ejector 114 and the surface 102 in response to receipt of one or more signals from the standoff sensors 204 containing information or data representative of the distance or standoff between the second liquid ejector 114 and the surface 102. In some implementations, the control circuit 120 may alter, control, or otherwise adjust the distance or standoff between the second liquid ejector 114 and the surface 102 to compensate for one or more detected contours and/or irregularities in the surface 102.

The actuateable elements 210 control the position of both the first liquid ejector 112 and the second liquid ejector 114 along an axis normal to the graphic swathe 140 (i.e., along the y-axis as depicted in FIG. 2A). Such an arrangement advantageously maintains a constant offset between the first liquid ejector 112 and the second liquid ejector 114 while permitting individual adjustment of the distance or standoff between the first liquid ejector 112 and the surface 102 and the distance or standoff between the second liquid ejector 114 and the surface 102. Such an arrangement may beneficially compensate for changes in standoff distance caused by curvature of the surface 102.

The print head 200 may further include at least one laser line projector 216 and a laser image acquisition device 116C. In at least some implementations, the laser line projector 216 may project onto the surface 102 and the laser image acquisition device 116C may communicate at least one signal that includes information or data representative of a contour or irregularities in the surface 102 to the control circuit 120. In some implementations, the at least one laser line projector 216 and a laser image acquisition device 116C may provide information and/or data to the control circuit 120 sufficient to generate of high resolution maps of the surface that permit the control circuit to preemptively detect surface contours and irregularities. In some implementations, the at least one laser line projector 216 and a laser image acquisition device 116C may provide information and/or data to the control circuit 120 sufficient to avoid obstructions or other elements present on the surface 102.

Figure 3:
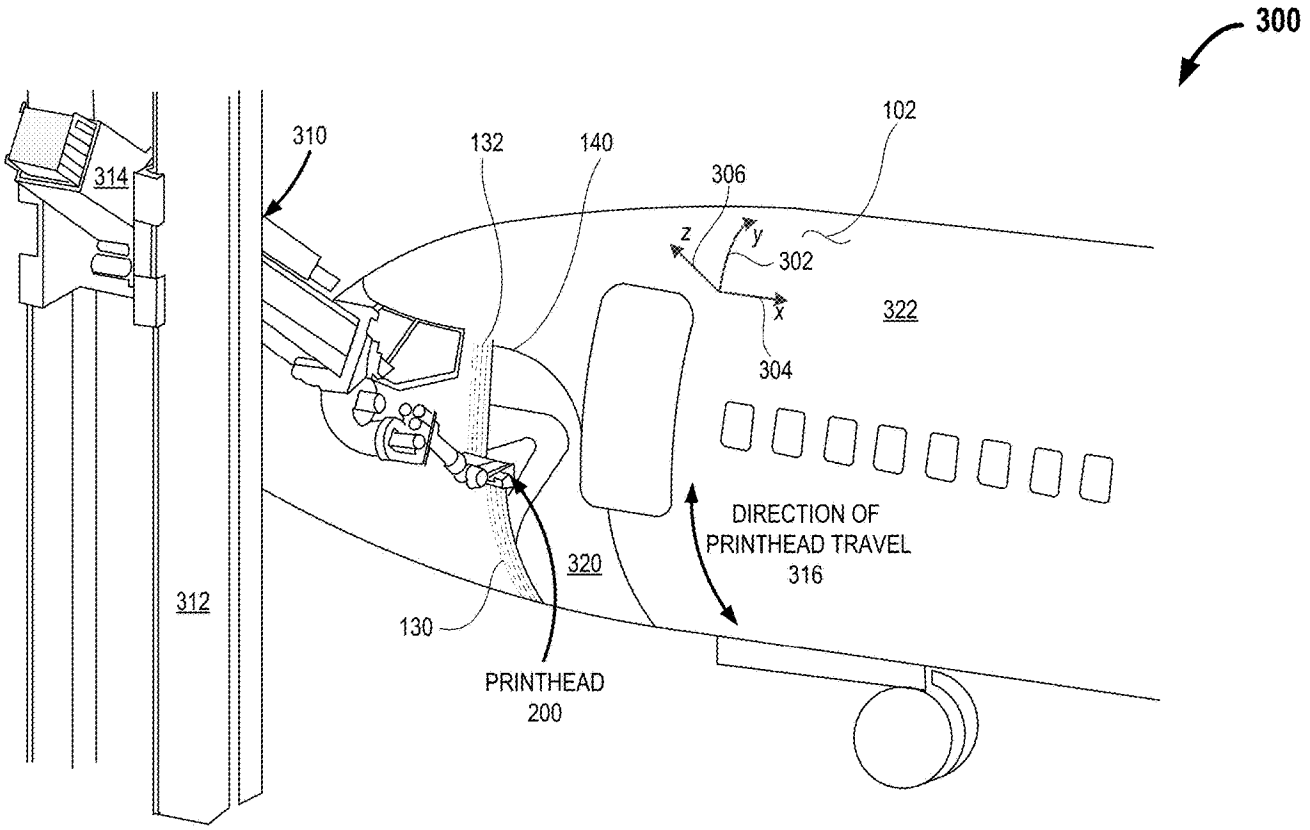
FIG. 3 is a perspective view of an illustrative large format inkjet printing system, such as depicted in FIGS. 1, 2A and 2B, mounted on a robotic arm and used to apply a large-scale graphic image to an exterior surface of a vehicle such as an aircraft, in accordance with at least one embodiment of the present disclosure.

FIG. 3 is a perspective view of an illustrative high-accuracy inkjet printing system 300 including a print head 200 mounted on a robotic assembly 310 that may be used to apply a large-scale graphic image to an exterior surface of an airliner, in accordance with at least one embodiment of the present disclosure. The robotic assembly 310 may include a gantry 312 and an arm 314. The print head 200 may be operably coupled to an end of the arm 314. In the illustrative embodiment depicted in FIG. 3, the robotic assembly 310 is applying a graphic 320 to a surface 102 that includes an aircraft fuselage 322. The robotic assembly 310 is passing the print head across the aircraft fuselage 322 in a direction of travel 316.

The encoder pattern 132 on the aircraft fuselage 322 may directly encode the linear travel along a first axis 302 that is in-plane with the aircraft fuselage 322 (e.g., the y-axis in FIG. 3) of the robot assembly 310. The encoder pattern 132 may repeat provided the unique encoder pattern length (i.e., the length of a single unique encoder pattern) exceeds the measurement uncertainty of the robotic assembly 310. By combining the approximate position of the robotic assembly 310 (e.g., approx. ±1 inch or ±25 mm) with the position determined by the encoder pattern 132, the position of the print head 110 along a single axis may be estimated to the resolution of the printed pixel size (e.g., 0.01 inches or 0.025 mm). Since the encoder pattern 132 is positioned at a defined position from the graphic swathe 140, the position of the print head 110 along a second axis 304 (e.g., the x-axis in FIG. 3) that is in-plane with and orthogonal to the first axis 302 should also be measurable to the pixel resolution. The yaw of the print head 110—the orientation of the print head 110 about a third axis 306 that is normal to the surface 102 and orthogonal to the first axis 302 and the second axis 306—(e.g., the z-axis in FIG. 3) may be estimated by the control circuit 120 by measuring an angle of the encoder pattern 132 on the aircraft fuselage 322. A standoff distance between the print head 110 and the aircraft fuselage 322, a roll angle of the print head 110 about the first axis 302, and a pitch angle of the print head 110 about the second axis 304 may be controlled by the control circuit 120 based at least in part on one or more standoff sensors 204A-204D and the IMU 202 coupled to the print head 110.

The state variables of the robotic assembly 310 include the pose of the print head 200 (e.g., the six (6) degrees-of-freedom described in the previous paragraph) and the velocity of the print head 200 across the aircraft fuselage 322. The state variables of the robotic assembly 310 may be estimated using a model, generated for the motion of the print head 200 and the print head measurements (e.g., standoff from the aircraft fuselage 322). Such a model may provide the state variables with less uncertainty than estimates generated using individual measurements. In some implementations, such models enable the estimation of the position of the robotic assembly 310 along the print direction 316 to a greater level of accuracy than the printed resolution (e.g., 100 dots per inch) of the encoder pattern 132. A Kalman Filter, an Extended Kalman Filter (EKF), a Double Exponential Smoothing Filter, a Particle filter, a Gauss-Newton Filter, Recursive Total Least Squares Filter, or a Nonlinear Bayesian Filter may be used as the basis for such a predictive model useful for controlling the robotic assembly 310 and consequently the movement of the print head 200 across the surface 102. Advantageously, such predictive models may be used to accurately predict state variables, thereby permitting the control circuit 120 to compensate for any latency that exists between the completion of the image processing and communication of one or more control signals to the robotic assembly 310.

In some implementations, vibration may introduce undesirable high-frequency motion disturbances at the print head 200. These vibrations may be detected and the amplitude of such vibrations measured by the IMU 202. The control circuit 120 may combine the acceleration at least one signal provided by the IMU 202 with the estimated position of the robotic assembly 310 and the encoder pattern 132 data obtained from the image acquisition device 116 to manage both low-frequency, long-term drift and high-frequency disturbances.

Figure 4:
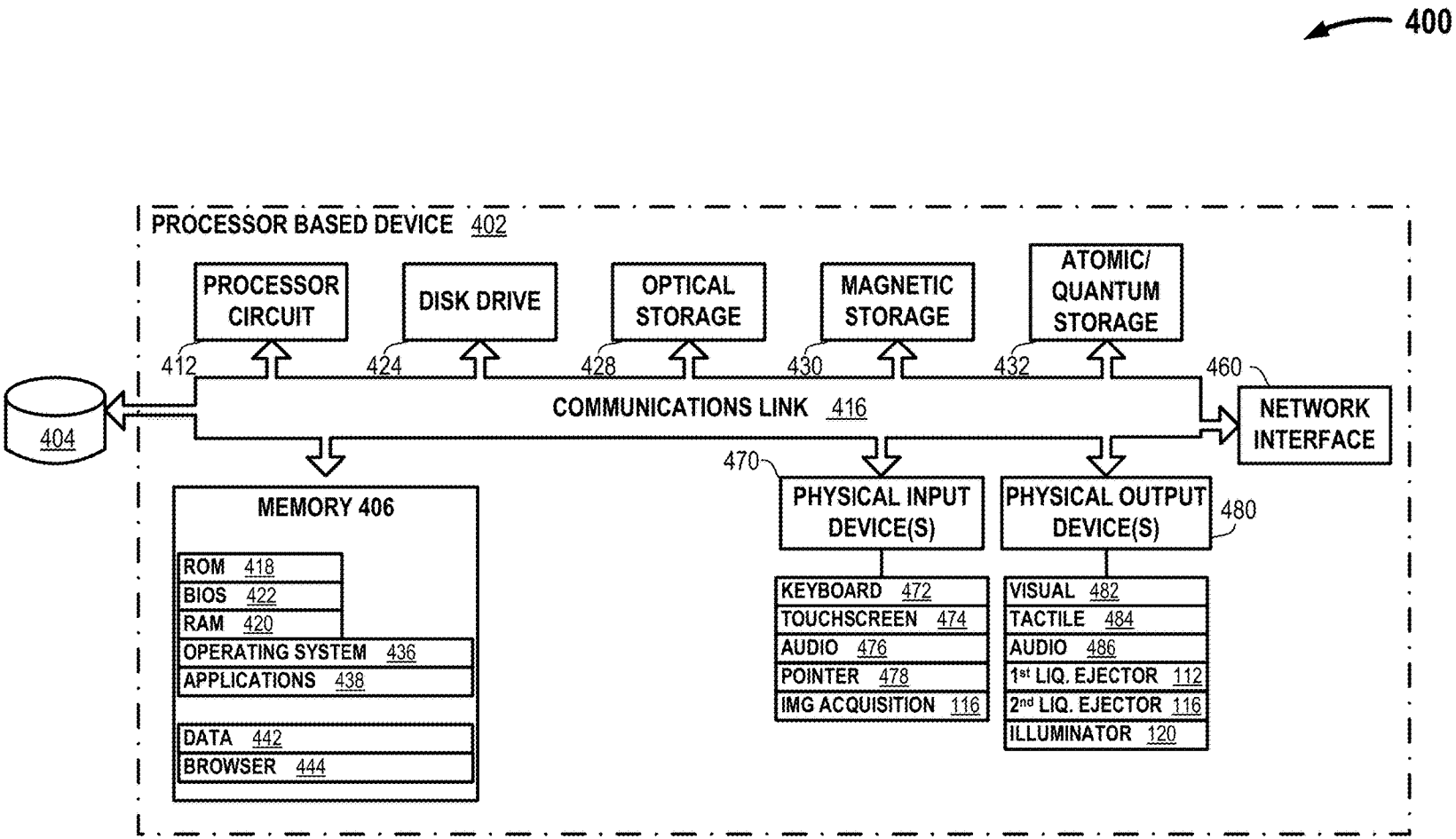
FIG. 4 is a block diagram of an illustrative processor-based device capable of controlling one or more functions of the large format inkjet printing system, in accordance with at least one embodiment of the present disclosure.

FIG. 4 depicts an illustrative high-accuracy inkjet printing environment 400 in which the high-accuracy inkjet printing system described above may be implemented, in accordance with at least one embodiment of the present disclosure. The processor-based device 402 may, on occasion, include one or more processor circuits 412 communicably coupled to one or more processor-readable storage devices 404. The processor-readable storage device 404 may be communicably coupled to the one or more processor-based devices 402 via one or more communications links 416, for example one or more parallel cables, serial cables, or wireless channels capable of high speed communications, for instance via BLUETOOTH®, universal serial bus (USB), FIREWIRE®, or similar.

The one or more processor-based devices 402 may be communicably coupled to one or more external devices, such as one or more high-accuracy inkjet print heads 200 and/or one or more robotic assemblies 310, using one or more wireless or wired network interfaces 460. Example wireless network interfaces 460 may include, but are not limited to, BLUETOOTH®, near field communications (NFC), ZigBee, IEEE 802.11 (Wi-Fi), 3G, 4G, LTE, CDMA, GSM, and similar. Example wired network interfaces 460 may include, but are not limited to, IEEE 802.3 (Ethernet), and similar. Unless described otherwise, the construction and operation of the various blocks shown in FIG. 4 are of conventional design. As a result, such blocks need not be described in further detail herein, as they will be understood by those skilled in the relevant art.

The large-area inkjet printing environment 400 may include one or more circuits capable of executing processor-readable instructions to provide any number of particular and/or specialized processor circuits 412, a system memory 406 and a system communications link 416 that bidirectionally communicably couples various system components including the system memory 406 to the processor circuit(s) 412. The processor circuit(s) 412 may include, but are not limited to, any circuit capable of executing one or more machine-readable and/or processor-readable instruction sets, such as one or more single or multi-core central processing units (CPUs), digital signal processors (DSPs), application-specific integrated circuits (ASICs), field programmable gate arrays (FPGAs), systems on a chip (SoCs), etc. In at least some implementations, at least a portion of the processor circuit(s) 412 may include one or more control circuits 120 as described above.

The communications link 416 may employ any known bus structures or architectures, including a memory bus with memory controller, a peripheral bus, and/or a local bus. The system memory 406 includes read-only memory ("ROM") 418 and random access memory ("RAM") 420. A basic input/output system ("BIOS") 422, which may, on occasion, form part of the ROM 418, contains basic routines that may cause the transfer information between elements within the processor-based device 402, such as during start-up.

The processor-based device 402 may include one or more disk drives 424, one or more optical storage devices 428, one or more magnetic storage devices 430, and/or one or more atomic or quantum storage devices 432. The one or more optical storage devices 428 may include, but are not limited to, any current or future developed optical storage drives (e.g., compact disc (CD), digital versatile disk (DVD), and similar). The one or more magnetic storage devices 430 may include, but are not limited to, any type of current or future developed rotating or stationary device in which data is stored in a magnetic and/or electromagnetic format such as a solid-state drive (SSD) and various forms of removable storage media (e.g., secure digital (SD), secure digital high capacity (SD-HC), universal serial bus (USB) memory stick, and similar). The one or more atomic or quantum storage devices may include, but are not limited to, any current or future developed atomic spin, molecular storage devices. The one or more disk drives 424, the one or more optical storage devices 428, the one or more magnetic storage devices 430, and the one or more atomic/quantum storage devices 432 may include integral or discrete interfaces or controllers (not shown).

Machine-readable instruction sets may be stored or otherwise retained in whole or in part in the system memory 406. Such machine-readable instruction sets may include, but are not limited to an operating system 436, one or more application instruction sets 438, system, program, and/or application data 442, and one or more communications applications such as a Web browser 444. The one or more application instruction sets 438 may include one or more structured light analysis instruction sets. When executed by the control circuit 120, the one or more structured light analysis instruction sets may cause the control circuit 120 to generate a structured light pattern on the surface 120 and determine at least one parameter associated with a contour or irregularity in the surface 120.

The one or more application instruction sets 438 may include one or more encoder pattern generation instruction sets. When executed by the control circuit 120, the one or more encoder pattern generation instruction sets may cause the control circuit 120 to cause the second liquid ejector 114 to deposit a defined encoder pattern 132 in the form of an encoder pattern swathe 130 on the surface 102. The one or more encoder pattern generation instruction sets may also permit the control circuit 120 to determine a physical location on the surface 102 based at least in part on information or data collected from an encoder pattern on the surface 102 that is captured by the image acquisition device 116.

The one or more application instruction sets 438 may include one or more graphic pattern generation instruction sets. When executed by the control circuit 120, the one or more graphic pattern generation instruction sets may cause the control circuit 120 to cause the first liquid ejector 112 to deposit a graphic image in the form of a graphic swathe $\mathbf{140}_n$ on the surface 102. In at least some implementations, the deposition of the graphic swathe $\mathbf{140}_n$ may be contemporaneous with the deposition of an encoder pattern swathe $\mathbf{130}_n$. In at least some implementations, the one or more graphic pattern generation instruction sets may cause the control circuit 120 to cause the first liquid ejector 112 to deposit a graphic image in the form of a graphic swathe $\mathbf{140}_{n+1}$ over an encoder pattern swathe $\mathbf{130}_n$ that is used to align the current graphic swathe $\mathbf{140}_{n+1}$ with a previously applied graphic swathe $\mathbf{140}_n$.

The one or more application instruction sets 438 may include one or more graphic image start instruction sets. When executed by the control circuit 120, the one or more graphic image start instruction sets may cause the control circuit 120 to cause the second liquid ejector 114 to deposit an initial encoder pattern 132 in the form of an encoder pattern swathe 130 on the surface 102. In at least some implementations, the control circuit 120 may autonomously determine a location on the surface 102 for the initial encoder pattern. In some implementations, the control circuit 120 may autonomously determine a location on the surface 102 for the initial encoder pattern 132 based at least in part on the one or more physical parameters of the surface 102 (e.g., the physical size of the surface) and/or one or more physical parameters of the final graphic image applied to the surface (e.g., the physical size of the completed graphic image).

The one or more application instruction sets 438 may include one or more graphic image end instruction sets. When executed by the control circuit 120, the one or more graphic image end instruction sets may cause the control circuit 120 to cause the second liquid ejector 114 to not deposit an encoder pattern in the form of an encoder pattern swathe 130 on the surface 102 when the final graphic swathe 140 is deposited on the surface 102.

While shown in FIG. 4 as being stored in the system memory 406, the operating system 436, application instruction sets 438, system, program, and/or application data 442 and browser 444 may, on occasion, be stored in whole or in part on one or more other storage devices such as the one or more disk drives 424, the one or more optical storage devices 428, the one or more magnetic storage devices 430, and/or one or more atomic, molecular, or quantum storage devices 432.

A system user may enter commands and information into the processor-based device 402 using one or more physical input devices 470. Example physical input devices 470 include, but are not limited to, one or more keyboards 472, one or more touchscreen I/O devices 474, one or more audio input devices 476 (e.g., microphone) and/or one or more pointing devices 478. These and other physical input devices may be communicably coupled the processor-based device 402 through one or more wired or wireless interfaces such as a wired universal serial bus (USB) connection and/or a wireless BLUETOOTH® connection.

The system user may receive output from the processor-based device 402 via one or more physical output devices 480. Example physical output devices 480 may include, but are not limited to, one or more visual or video output devices 482, one or more tactile or haptic output devices 484, and/or one or more audio output devices 486. The one or more video or visual output devices 482, the one or more tactile output devices 484, and the one or more audio output devices 486 may be communicably coupled to the communications link 416 via one or more interfaces or adapters.

Figure 5:
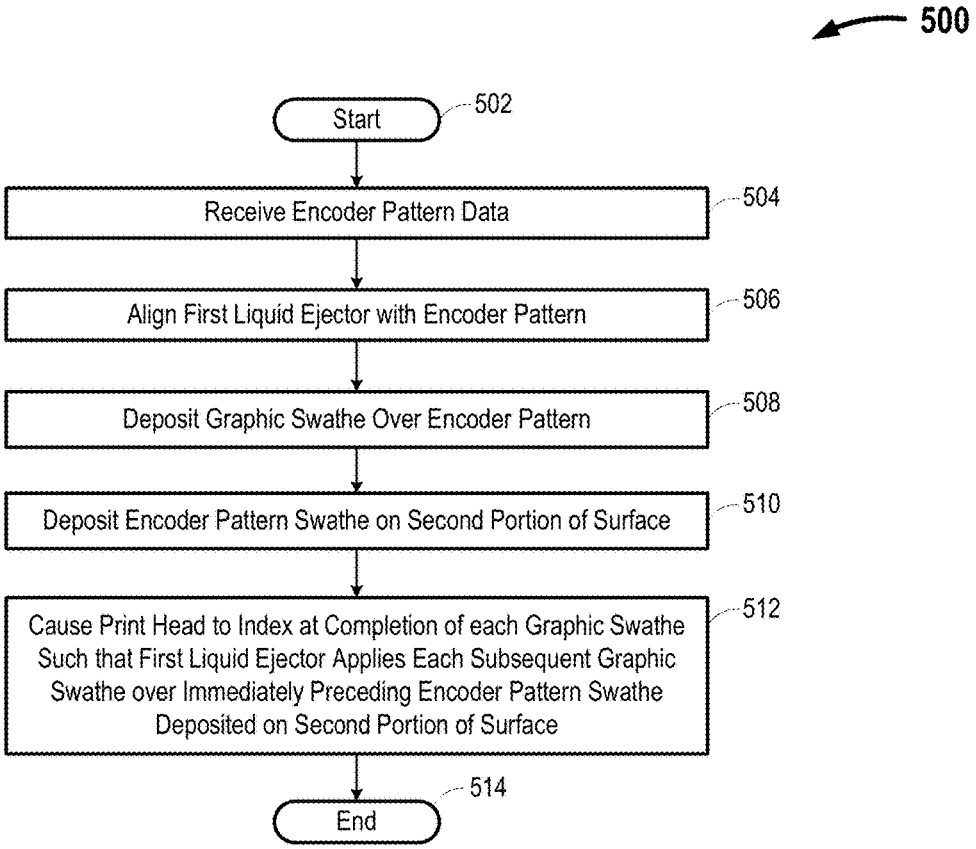
FIG. 5 is a high-level flow diagram of an illustrative large format inkjet printing method, in accordance with at least one embodiment of the present disclosure.

FIG. 5 is a high-level flow diagram of an illustrative high-accuracy inkjet printing method 500, in accordance with at least one embodiment of the present disclosure. The method commences at 502.

At 504, the control circuit 120 receives at least one signal from the image acquisition device 116. The at least one signal includes information or data representative of an encoder pattern 132 that falls within the field of view of the image acquisition device. The encoder pattern 132 permits the control circuit 120 to determine the location of the print head 200 with respect to the encoder pattern swathe $\mathbf{130}_n$. Since the encoder pattern swathe $\mathbf{130}_n$ is positioned a known distance from the immediately preceding graphic swathe $\mathbf{140}_n$, by determining the location of the print head 200 with respect to the encoder pattern swathe $\mathbf{130}_n$, the control circuit 120 also determines the location of the print head 200 with respect to the immediately preceding graphic swathe $\mathbf{140}_n$.

At 506, the control circuit 120 aligns the first liquid ejector 112 with the encoder pattern swathe $\mathbf{130}_n$. In some implementations, the control circuit 120 may align the first liquid ejector 112 such that the first liquid ejector 112 deposits at least a portion of the graphic swathe $\mathbf{140}_{n+1}$ over (i.e., on top of) at least a portion of the encoder pattern swathe $\mathbf{130}_n$. In some implementations, the control circuit 120 may align the first liquid ejector 112 such that the first liquid ejector 112 deposits at least a portion of the graphic swathe $\mathbf{140}_{n+1}$ remote from all or a portion of the encoder pattern swathe $\mathbf{130}_n$.

At 508, the control circuit 120 causes the first liquid ejector 112 to deposit the graphic swathe $\mathbf{140}_{n+1}$ on or over at least a portion of the encoder pattern swathe $\mathbf{130}_n$ on the surface 102. As the graphic swathe $\mathbf{140}_{n+1}$ is deposited, the control circuit periodically, intermittently, aperiodically, or continuously determines the location of the print head 200 based on the encoder pattern 132 in encoder pattern swathe $\mathbf{130}_n$. The encoder pattern swathe $\mathbf{130}_n$ provides the control circuit 120 with the ability to align graphic swathe $\mathbf{140}_{n+1}$ with the immediately preceding graphic swathe $\mathbf{140}_n$. Further, the use of the encoder pattern 132 permits the control circuit 120 to cause the first liquid ejector 112 to align adjacent graphic swathes $\mathbf{140}_{n-1}/\mathbf{140}_n/\mathbf{140}_{n+1}$ to achieve a printing resolution of about 50 dots per inch (dpi); about 100 dpi; about 200 dpi; about 300 dpi; about 450 dpi; or about 600 dpi. Such location determination allows the high-accuracy inkjet printing system 100 to apply a large-scale graphic image to the surface 102 using any number of graphic swathes $\mathbf{140}_1$-$\mathbf{140}_x$.

At 510, the control circuit 120 causes the second liquid ejector 114 to deposit the encoder pattern swathe $\mathbf{130}_{n+1}$ at a defined location with respect to the most recently deposited graphic swathe $\mathbf{140}_{n+1}$. In some implementations, the control circuit 120 may cause the second liquid ejector 114 to deposit the encoder pattern swathe $\mathbf{130}_{n+1}$ in a defined location that is proximate or adjacent to the most recently deposited graphic swathe $\mathbf{140}_{n+1}$. In some implementations, the control circuit 120 may cause the second liquid ejector 114 to deposit the encoder pattern swathe $\mathbf{130}_{n+1}$ in a defined location remote from the graphic swathe $\mathbf{140}_{n+1}$.

At 512, the control circuit causes the print head 200 to index after completing the graphic swathe 140. In at least one embodiment, the control circuit 120 indexes the print head 200 such that the first liquid ejector 112 aligns with the encoder pattern 132 in encoder pattern swathe $\mathbf{130}_{n+1}$ and positions the first liquid ejector 112 at a location proximate the most recently applied graphic swathe 140. The method 500 concludes at 514.

Figure 6:
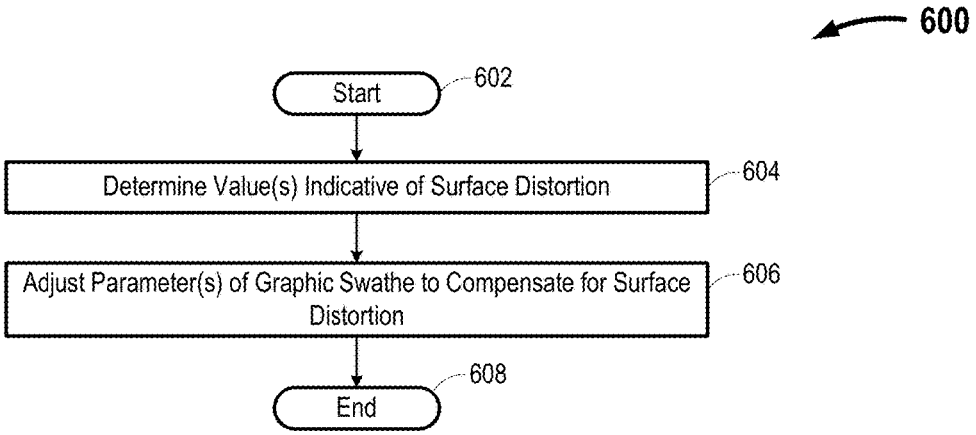
FIG. 6 is a high-level flow diagram of an illustrative large format inkjet printing method that includes measuring a surface distortion and adjusting one or more parameters of the graphic swathe to compensate for the measured surface distortion, in accordance with at least one embodiment of the present disclosure.

FIG. 6 is a high-level flow diagram of an illustrative high-accuracy inkjet printing method 600 that includes measuring a surface distortion and adjusting one or more parameters of the graphic swathe to compensate for the measured surface distortion, in accordance with at least one embodiment of the present disclosure. The control circuit 120 may implement the method 600 in conjunction with the high-accuracy inkjet printing method 500 described in detail above. In some implementations, the surface 102 may include various distortions, contours, and/or irregularities that would degrade the quality of or introduce distortion to a graphic image applied to the surface 102. In such instances, the control circuit 120 may detect such distortions, contours, and irregularities in the surface 102 and may alter or adjust one or more parameters in one or more graphic swathes 140 to minimize or even eliminate the degradation in quality or distortion introduced by a particular distortion, contour, or irregularity. The method 600 commences at 602.

At 604, the control circuit 120 receives one or more signals that include information or data representative of a distortion, contour, or irregularity in the surface 102. In at least some implementations, the print head 200 may include a laser emitter 216 that projects onto the surface 102 and a laser image acquisition device 116C. The signal generated by the laser image acquisition device 116C may include information or data indicative of distortions, contours, and/or irregularities in the surface 102. The control circuit 120 may determine one or more parameters associated with the distortion, contour, and/or irregularity in the surface 102 based at least in part on the laser information or data included in the signal received from the laser image acquisition device 116C.

In some implementations, the print head 200 may include one or more structured light sources that project onto the surface 102. In such an implementation, the image acquisition device 116 may provide one or more signals that include information or data representative of the structured light pattern on the surface 102. The control circuit 120 may determine one or more parameters associated with the distortion, contour, and/or irregularity in the surface 102 based at least in part on the structured light information or data included in the signal received from the image acquisition device 116A.

In some implementations, the control circuit 120 may detect distortions, contours, and/or irregularities in the surface 102 prior to commencing deposition of the first graphic swathe 140. In some implementations, the control circuit 120 may detect distortions, contours, and/or irregularities in the surface 102 "on the fly" or contemporaneous with the deposition of a graphic swathe 140.

At 606, the control circuit 120 may alter or adjust one or more parameters of the graphic swathe 140 in response to detecting a distortion, contour, or irregularity in the surface 102. The one or more parameters may include, but are not limited to, a color, a hue, a brightness, a color density, or combinations thereof. The method 600 concludes at 608.

Figure 7:
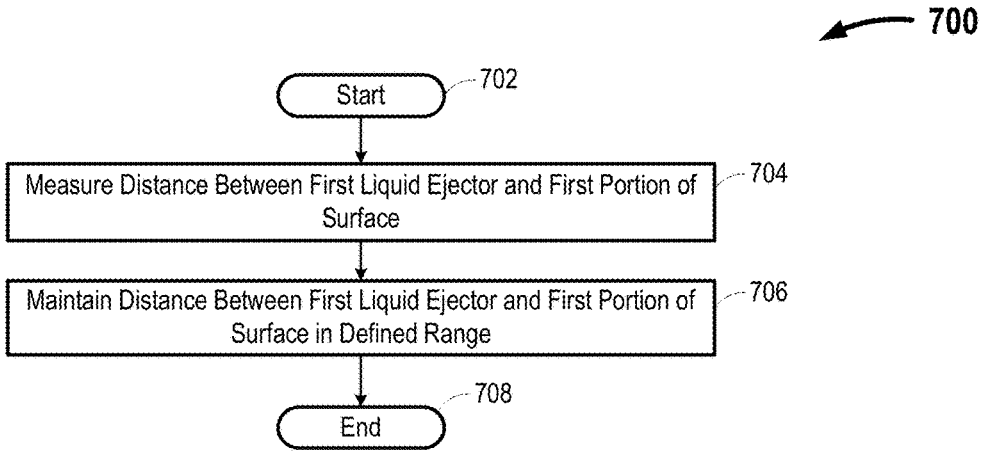
FIG. 7 is a high-level flow diagram of an illustrative large format inkjet printing method that includes measuring a distance between a first liquid ejector and a surface and maintaining the measured distance within a defined range, in accordance with at least one embodiment of the present disclosure.

FIG. 7 is a high-level flow diagram of an illustrative high-accuracy inkjet printing method 700 that includes measuring a distance between a first liquid ejector 112 and a surface 102 and maintaining the measured distance within a defined range, in accordance with at least one embodiment of the present disclosure. Inkjet printing deposits a liquid on the surface in a precise dot pattern to form a graphic image. Maintaining a consistent distance between the inkjet print head 200 and the surface 102 may improve the quality of the resultant graphic image. The method 700 commences at 702.

At 704, the control circuit 120 receives one or more signals from the standoff sensors 204. The one or more signals provided by the standoff sensors 204 may include information or data representative of a measured distance between the print head 200 and the surface 102.

At 706, the control circuit 120 generates one or more output signals that are communicated to the vertical linear actuators 212 operably coupled to the first liquid ejector 112 and/or to the vertical linear actuators 214 operably coupled to the second liquid ejector 114. The control circuit 120 may cause the vertical linear actuators 212 to adjust the position of the first liquid ejector 112 such that the distance between the first liquid ejector 112 and the surface 102 is maintained within a defined range. The control circuit 120 may cause the vertical linear actuators 214 to adjust the position of the second liquid ejector 114 such that the distance between the second liquid ejector 114 and the surface 102 is maintained within a defined range. The method 700 concludes at 708.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

What is claimed:

1. A liquid application system comprising:

at least one print head that includes:

a first liquid ejector to deposit a pigmented liquid on a surface;

a second liquid ejector to deposit a liquid on the surface; and at least one image acquisition device;

a plurality of actuateable elements operably coupled to the at least one print head; and a print head controller communicably coupled to the first liquid ejector, the second liquid ejector, the plurality of actuateable elements, and the at least one image acquisition device, the print head controller to:

align the first liquid ejector with an encoder pattern on a first portion of the surface, the alignment based at least in part on image data received from the at least one image acquisition device;

cause the first liquid ejector to selectively deposit the pigmented liquid as a graphic swathe across at least a portion of the encoder pattern on the first portion of the surface; and cause the second liquid ejector to selectively deposit the liquid as the encoder pattern on a second portion of the surface.

2. The liquid application system of claim 1 wherein a first print head includes the first liquid ejector and a second print head includes the second liquid ejector.

3. The liquid application system of claim 1 wherein a first print head includes both the first liquid ejector and the second liquid ejector.

4. The liquid application system of claim 1, the print head controller to further:

index the print head at the completion of each graphic swathe such that the first liquid ejector deposits each subsequent graphic swathe over the encoder pattern previously deposited on the second portion of the surface.

5. The system of claim 4 the print head controller to further:

cause the second liquid ejector to selectively deposit the encoder pattern on the second portion of the surface at a location defined with respect to the first portion of the surface.

6. The system of claim 5 wherein the second portion of the surface is adjacent to at least a portion of the first portion of the surface.

7. The system of claim 5 wherein the second portion of the surface overlays at least a portion of the first portion of the surface.

8. The system of claim 4, the print head controller to further:

cause the second liquid ejector to selectively deposit the encoder pattern swathe on the second portion of the surface contemporaneous with the application of the graphic swathe to the first portion of the surface by the first liquid ejector.

9. The system of claim 1, wherein the print head controller further includes:

a plurality of distance measurement devices to measure a distance between at least the first liquid ejector and the first portion of the surface.

10. The system of claim 9, the print head controller to further:

receive information that includes data indicative of the measured distance between at least the first liquid ejector and the surface; and maintain the first liquid ejector within a defined distance range from the first portion of the surface.

11. The system of claim 1 wherein the first liquid ejector comprises a multi-color inkjet print head.

12. The system of claim 11, further comprising a plurality of fluid reservoirs, each of the plurality of fluid reservoirs fluidly coupled to the first liquid ejector, each of the reservoirs to receive at least one pigmented fluid.

13. The system of claim 1 wherein the second liquid ejector comprises a multi-color inkjet print head.

14. The system of claim 1, the print head controller to further:

selectively adjust the application of the graphic swathe to the first portion of the surface based at least in part on data representative of a three-dimensional contour map of the surface.

15. The system of claim 1, further comprising a housing disposed at least partially about at least the first liquid ejector, the second liquid ejector, and the at least one image acquisition device;

wherein the at least one image acquisition device is disposed at a defined location in the print head with respect to the first liquid ejector.

16. The system of claim 1, wherein at least some of the plurality of actuateable elements include at least one actuateable element operably coupled to the first liquid ejector, the at least one actuateable element to adjust a distance between the first liquid ejector and the first portion of the surface.

17. The system of claim 1, wherein at least some of the plurality of actuateable elements include at least one actuateable element operably coupled to the second liquid ejector, the at least one actuateable element to adjust a distance between the second liquid ejector and the second portion of the surface.

18. The system of claim 1, further comprising:

a high-bandwidth linear actuator operably coupled to the print head control circuit to track the encoder pattern along at least one axis.

19. The system of claim 18 wherein the high-bandwidth linear actuator operably coupled to the print head control circuit to track the encoder pattern along at least one axis comprises a high-bandwidth linear actuator operably coupled to the print head control circuit to track the encoder pattern along at least one axis, the at least one axis normal to a direction of travel of the first liquid ejector.

20. The system of claim 1:

wherein the print head has a defined measurement uncertainty along the encoder pattern;

wherein the encoder pattern comprises a number of repeating encoder pattern segments; and wherein a length of each encoder pattern segment is equal to or greater than the defined measurement uncertainty of the print head.

21. A pigmented liquid application method, comprising:

receiving, by a print head control circuit, data representative of an encoder pattern present on a first portion of a surface;

based at least in part on the data representative of the encoder pattern, aligning a first liquid ejector with the encoder pattern;

causing, by the print head control circuit, the first liquid ejector to selectively deposit a graphic swath at a defined location with respect to at least a portion of the encoder pattern;

causing, by the print head control circuit, the second liquid ejector to selectively deposit the encoder pattern on a second portion of the surface; and causing, by the print head control circuit, the print head to index at the completion of each graphic swath such that the first liquid ejector applies each subsequent graphic swath at a defined location with respect to the immediately preceding encoder pattern deposited on the second portion of the surface.

22. The method of claim 21 wherein causing the print head to index at the completion of each graphic swath such that the first liquid ejector applies each subsequent graphic swath at a fixed location with respect to the immediately preceding encoder pattern comprises:

causing, by the print head control circuit, the print head to index at the completion of each graphic swath such that the first liquid ejector applies each subsequent graphic swath coincident with at least a portion of the immediately preceding encoder pattern deposited on the second portion of the surface.

23. The pigmented liquid application method of claim 21 wherein causing the second liquid ejector to selectively deposit the encoder pattern on a second portion of the surface comprises:

causing, by the print head control circuit, the second liquid ejector to selectively apply a gray-coded binary encoder pattern on the second portion of the surface.

24. The pigmented liquid application method of claim 21, further comprising:

determining, by the print head control circuit, at least one distortion value associated with the surface based, at least in part, on the encoder pattern deposited on the second portion of the surface.

25. The pigmented liquid application method of claim 24, further comprising:

altering, by the print head control circuit, at least one graphic swathe parameter based at least in part on the determined distortion value.

26. The pigmented liquid application method of claim 21, further comprising:

determining, by the print head control circuit, at least one distortion value associated with the surface based at least in part on a structured light scan of the surface.

27. The pigmented liquid application method of claim 21, further comprising:

maintaining, by the print head control circuit, a distance between the first liquid ejector and the surface within a defined range.

28. The pigmented liquid application method of claim 27 wherein maintaining a distance between the first liquid ejector and the surface within a defined range comprises:

receiving, by the print head control circuit, at least one distance signal from a communicably coupled ultrasonic transducer, the at least one distance signal including data representative of the distance between the first liquid ejector and the surface within a defined range.

29. The pigmented liquid application method of claim 27 wherein maintaining a distance between the first liquid ejector and the surface within a defined range comprises:

adjusting, by the print head control circuit, a position of at least one actuateable element operably coupled to the first liquid ejector to maintain the distance between the first liquid ejector and the surface within the defined range.

30. The pigmented liquid application method of claim 21, further comprising:

maintaining, by the print head control circuit, a distance between the first liquid ejector and the surface within a defined range.

31. The pigmented liquid application method of claim 21 wherein aligning a first liquid ejector with the encoder pattern comprises:

aligning the first liquid ejector with an encoder pattern comprising a number of repeating encoder pattern segments; wherein a length of each encoder pattern segment is equal to or greater than a defined measurement uncertainty of the print head.

32. A print head controller apparatus, comprising:

at least one input communicably coupleable to at least one optical scanner in a print head;

at least one output communicably coupleable to at least a first liquid ejector in the print head and a second liquid ejector in the print head; and at least one controller circuit communicably coupled to the at least one input interface and the at least one output interface, the controller circuit to:

receive, at the at least one input, at least one encoder pattern signal provided by the at least one optical scanner, the at least one encoder pattern signal including data indicative of an encoder pattern applied to a first portion of a surface;

responsive to the receipt of the at least one encoder pattern signal, align the print head with the at least one encoder pattern; and responsive to alignment of the print head with the at least one encoder pattern:

cause the first liquid ejector to selectively deposit a graphic swath at a defined location with respect to the encoder pattern; and cause the second liquid ejector to selectively deposit an encoder pattern on a second portion of the surface, the second portion of the surface at a defined location with respect to the first portion of the surface.

33. The print head controller of claim 32, the at least one controller circuit to further:

cause the print head to index at the completion of each graphic swath such that the first liquid ejector applies each subsequent graphic swath at a defined location with respect to the immediately preceding encoder pattern deposited on the second portion of the surface.

34. The print head controller of claim 32, the at least one controller circuit to further:

cause the print head to index at the completion of each graphic swath such that the first liquid ejector applies each subsequent graphic swath coincident with at least a portion of the immediately preceding encoder pattern deposited on the second portion of the surface.

35. The print head controller of claim 32, the at least one controller circuit to further:

index the print head at the completion of each graphic swath such that the first liquid ejector applies each subsequent graphic swath over the encoder pattern swath previously deposited on the second portion of the surface.

36. The print head controller of claim 32, the at least one controller circuit to further:

cause the second liquid ejector to selectively deposit the encoder pattern on the second portion of the surface contemporaneous with the deposition of the graphic swath on the first portion of the surface by the first liquid ejector.

37. The print head controller of claim 32, further comprising:

at least one input communicably coupleable to a distance measurement device; and at least one output communicably coupleable to at least one actuateable element;

the at least one controller circuit to further:

receive at least one distance signal that includes data representative of a distance between the first liquid ejector and the first portion of the surface; and provide at least one actuateable element output signal at the at least one output, the at least one actuateable element output signal to cause the at least one actuateable element to maintain the distance between the first liquid ejector and the first portion of the surface in a defined range.

38. The print head controller of claim 32, the controller to further:

align the first liquid ejector with an encoder pattern comprising a number of repeating encoder pattern segments; wherein a length of each encoder pattern segment is equal to or greater than a defined measurement uncertainty of the print head.

* * * * *